United States Patent [19]

Okubo et al.

[11] Patent Number: 4,799,814

[45] Date of Patent: Jan. 24, 1989

[54] PRINTER PAPER BAIL DEVICE

[75] Inventors: Toshimitsu Okubo, Shibata; Mamoru Takezawa, Yokohama; Mitsuyoshi Satoh, Shibata; Kazuhiro Suzuki, Sagamihara, all of Japan

[73] Assignee: Ricoh Company, Ltd., Tokyo, Japan

[21] Appl. No.: 839,046

[22] Filed: Mar. 12, 1986

[30] Foreign Application Priority Data

| | | | |
|---|---|---|---|
| Mar. 12, 1985 | [JP] | Japan | 60-49148 |
| Mar. 12, 1985 | [JP] | Japan | 60-49149 |
| Mar. 13, 1985 | [JP] | Japan | 60-49875 |
| Mar. 13, 1985 | [JP] | Japan | 60-49876 |
| Mar. 13, 1985 | [JP] | Japan | 60-49877 |
| Apr. 3, 1985 | [JP] | Japan | 60-49824 |
| Apr. 19, 1985 | [JP] | Japan | 60-84102 |
| Jun. 27, 1985 | [JP] | Japan | 60-141406 |

[51] Int. Cl.[4] ..... B41J 13/20

[52] U.S. Cl. ..... 400/639.1; 400/641

[58] Field of Search ..... 400/637.1, 639, 639.1, 400/639.2, 640, 641, 645, 645.5, 705 A, 705.5

[56] References Cited

U.S. PATENT DOCUMENTS

| | | | |
|---|---|---|---|
| 415,535 | 11/1889 | Lasar | 400/640 X |
| 739,277 | 9/1903 | Ambrose | 400/705.4 |
| 890,474 | 6/1908 | Wallin | 400/705.4 X |
| 1,900,102 | 3/1933 | Going | 400/639.1 X |
| 2,163,944 | 6/1939 | Helmond | 400/640 X |
| 2,217,160 | 10/1940 | Dodge | 400/640 X |
| 2,218,544 | 10/1940 | Metzner | 400/639.1 X |
| 2,356,842 | 8/1944 | Helmond | 400/640 X |
| 2,772,765 | 12/1956 | Maroth | 400/640 X |
| 2,808,919 | 10/1957 | Frobel | 400/637.1 X |
| 4,155,662 | 5/1979 | Maroth | 400/641 X |

FOREIGN PATENT DOCUMENTS

| | | | |
|---|---|---|---|
| 506057 | 8/1930 | Fed. Rep. of Germany | 400/639.1 |
| 659453 | 5/1938 | Fed. Rep. of Germany | 400/639.1 |
| 0164165 | 9/1984 | Japan | 400/641 |
| 3384 | of 1896 | United Kingdom | 400/645 |

*Primary Examiner*—Ernest T. Wright, Jr.

*Attorney, Agent, or Firm*—Oblon, Fisher, Spivak, McClelland & Maier

[57] ABSTRACT

A paper bail in a printer having a platen includes two bail levers rotatably mounted on the printer and pressed toward the platen by a spring. An elongate bail plate is formed as a flat metal sheet having a L-shaped section, one side of which extends substantially transverse to a line connecting the bail plate with a rotational axis of the bail levers. A bail roller on the bail plate is mounted thereon by an elastic member capable of permitting only axial movement of the bail roller when the bail roller is out of contact with the platen, and permitting only rotational movement of the bail roller when the bail roller is in contact with the platen.

8 Claims, 2 Drawing Sheets

PRINTER PAPER BAIL DEVICE

SUMMARY OF THE INVENTION

It is the object of the present invention to provide a paper bail for a printer which is remarkably cost-effective and, yet, capable of pressing a paper with high accuracy.

In accordance with one aspect of the invention, there is provided a paper bail in a printer having a platen, comprising two bail levers rotatably mounted on the printer, an elongate bail plate formed as a flat metal sheet having a substantially angle shaped section, angle shaped opposite ends of the bail plate fitting in correspondingly shaped slots of the bail levers. One side of the angle shaped section extends substantially transverse to a line connecting the bail plate with a rotational axis of the bail levers. Also included are at least one bail roller mounted on the bail plate in such a manner as to cooperate with the angle shape thereof. The bail plate is biased against the platen. The bail plate is light in weight and has increased resistance to twisting, and so the bail levers move in unison when one or the other is moved toward or away from the plate.

According to another feature of the invention, the bail plate is L-shaped and the side extending substantially transverse to the line connecting the bail plate with the rotational axis of the bail levers also extends toward the platen as seen from the joint with the other side of the L-shape.

According to another feature of the invention, the bail roller includes a cylindrical member engagable with the platen and an elastic means for supporting the cylindrical member on the bail plate such that the cylindrical member can rotate about the axis of the bail plate but cannot move along the axis when the bail roller is in contact with the platen, and can move along the axis but cannot rotate about the axis when the bail roller is not in contact with the platen.

The elastic member has an opening shaped to fit the bail plate, a substantially circular periphery in contact with the cylindrical member, and an elastic portion. The elastic member frictionally holds the cylindrical member when the bail roller is out of engagement with the platen and is distorted to frictionally hold the bail plate when the bail roller is in contact with the platen.

DESCRIPTION OF THE PREFERRED EMBODIMENT

Figure 1:
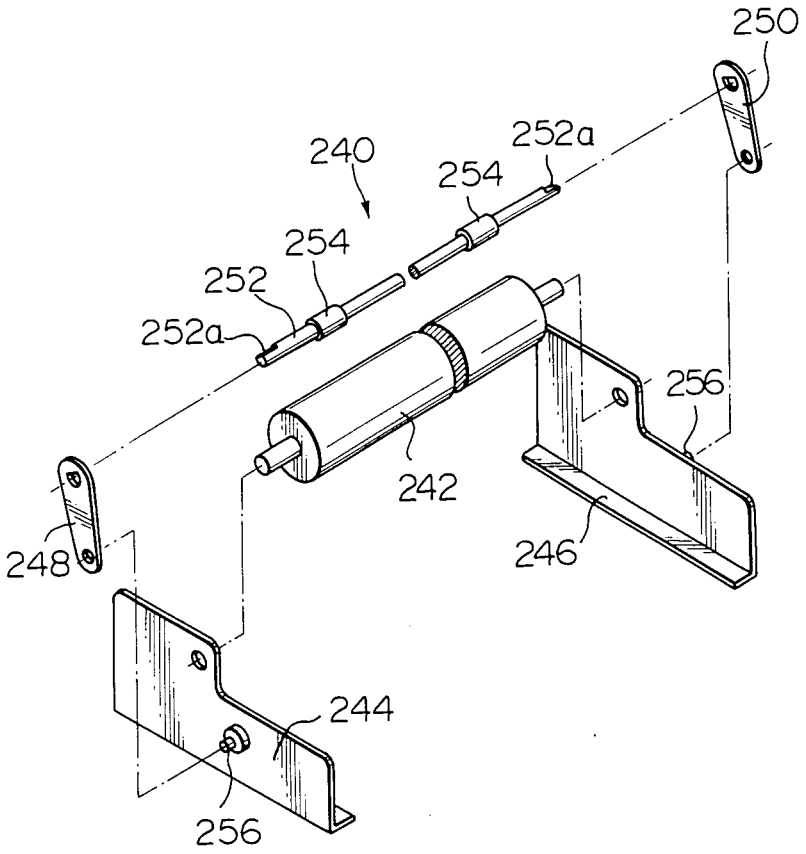
Fig. 1 PRIOR ART
FIG. 1 is an exploded perspective view of a prior art paper bail.

Referring to FIG. 1, a prior art paper bail 240 which is applicable to a printer of the type described is shown. The paper bail 240 is supported by laterally opposite side frames 244 and 246 together with a platen 242. As shown, the paper bail 240 comprises bail levers 248 and 250, a bail shaft 252 opposite ends of which are held by tip portions of the bail levers 248 and 250, and bail rollers 254 which are rotatably mounted on the bail shaft 252. The bail levers 248 and 250 are rotatably mounted at their other end on stubs 256 which extend respectively from the outer surfaces of the side frames 244 and 246. The bail rollers 254 are pressed against the platen 242 to retain a paper which wraps around the platen 242.

In the prior art paper bail 240, the bail shaft 252 is implemented by a round shaft made of stainless steel, for example, and, in addition, the round shaft is milled to have flat surfaces 252*a* at opposite ends thereof so that the shaft 252 may be prevented from rotating relative to the bail levers 248 and 250. This results in a drawback that the paper bail 240 is expensive. In addition, since the opposite bail levers 248 and 250 are interconnected by the round shaft 252, rotation of one of the bail levers 248 and 250 causes the bail shaft 252 to twist so that the other bail lever 248, 250 cannot accurately follow the rotation and the bail levers 248, 250 do not move in unison.

Figure 2:
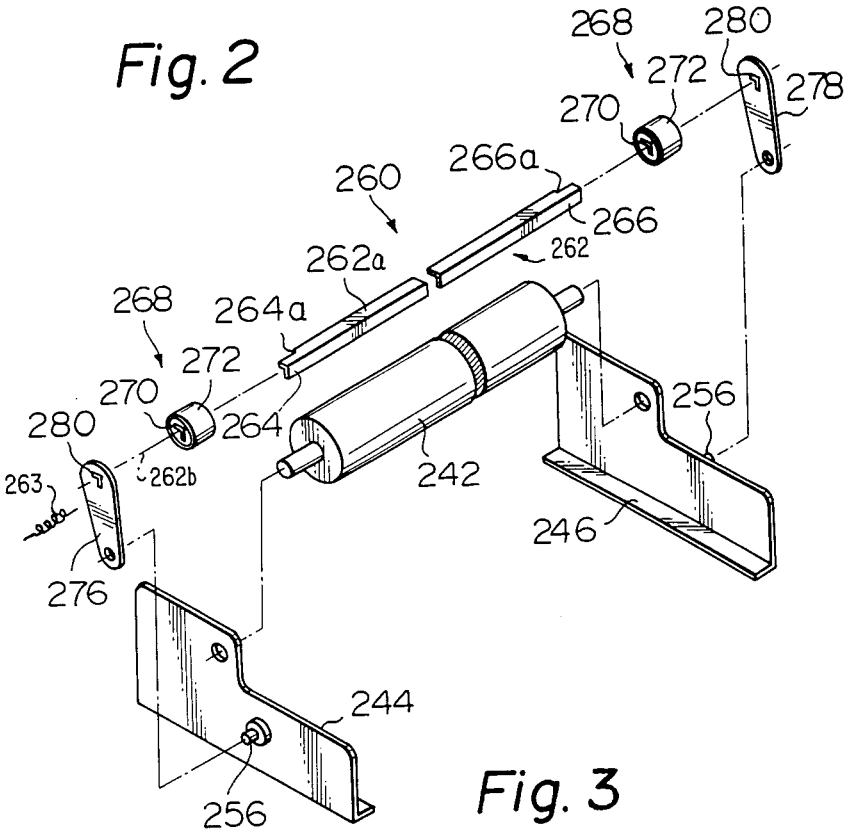
FIG. 2 is an exploded perspective view of a paper bail in accordance with the present invention which is shown together with a platen and a side frames of a priner.

Referring to FIG. 2, a paper bail for a printer in accordance with the present invention is shown. The paper bail, generally 260, includes a bail plate 262 which is formed by bending an elongate flat member along its length. In this particular embodiment, the bail plate 262 comprises a metal sheet which is bent to have a generally L-shaped cross-section. At opposite ends 264 and 266, the bail plate 262 is notched at one side to have stepped portions 264*a* and 266*a*. A plurality of bail rollers 268 are mounted on the bail plate 262.

Figure 3:
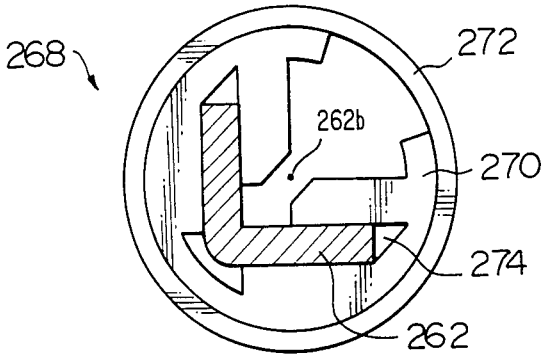
FIG. 3 is a side elevation of bail rollers shown together with a section of a bail plate.

As shown in FIG. 3, each bail roller 268 comprises an elastic member 270 made of a plastic, for example, and a cylindrical member 272 which is rotatably mounted on the outer periphery of the elastic member 270. The elastic member 270 is formed with a generally L-shaped through opening 274 which is complimentary in shape to the bail plate 262. The bail plate 262 is inserted in the openings 274 of the elastic members 270, whereby the bail rollers 268 are mounted to the bail plate 262. In this configuration, the bail rollers 268 are retained by the elastic members 270 such that they are movable along the axis 262*b* of the bail plate 262 (FIG. 2) but not rotatable about said axis 262*b*. However, once the bail rollers 268 are pressed against the platen 242, the elastic members 270 will prevent the bail rollers 268 from readily sliding along the axis 262*b* of the bail shaft 262 due to their distortion. The cylindrical members 272 are then each rotatable about their associated elastic members 270 relative to the bail plate 262 due to the distortion of the elastic member 270.

The bail plate 262 with the bail rollers 268 is secured to bail levers 276 and 278 with opposite ends thereof 264 and 266 inserted respectively into generally L-shaped openings 280 which are formed through the bail levers 276 and 278. While forces may be applied axially to the bail plate 262, the stepped portions 264*a* and 266*a* of the bail plate 262 abut respectively against the inner surfaces of the bail levers 276 and 278 so that the bail plate 262 is prevented from being moved axially.

The paper bail 260 having the above structure is supported rotatably about the stubs 256 by the side frames 244 and 246. The paper bail 260 is suitably driven into pressing contact with the platen 242 by spring 263 to press a paper wrapped around the platen 242. One side 262*a* if the bail plate 262 extends substantially transverse to a line connecting openings 280 with the axis defined by stubs 256, which increases the resistance of the bail plate 262 torsional bending by the spring 263

While the paper bail 260 in this particular embodiment has the bail plate 262 which is implemented with a metal sheet having a generally L-shaped cross-section, the metal sheet may be provided with any other suitable cross-section insofar as it preserves sufficient strength against torsion which may develop at opposite ends of the bail plate 262. The paper bail 260 with the above construction is applicable not only to various kinds of printers but also to a plotter typewriter and other printing apparatuses.

A bail plate 262 is produced according to the invention by bending a flat member along the length thereof that is, along a line parallel to axis **262*b* so that the production steps are simple to reduce to cost. Moreover, the bail plate 262 is prevented from twisting at opposite ends thereof to in turn allow bail levers 276, 278** to accurately follow each other during rotation, thereby accurately pressing a paper.

Various modifications will become possible for those skilled in the art after receiving the teachings of the present disclosure without departing from the scope thereof.

What is claimed is:

1. A paper bail in a printer having a platen, comprising:

two bail levers movably mounted on said printer;

an elongate bail plate formed as a flat metal sheet having a substantially angle shaped section, angled shaped opposite ends of said bail plate fitting in correspondingly shaped slots of said bail levers;

at least one bail roller including bail roller mounting means cooperating with said angle-shaped section for mounting said bail roller on said bail plate; and means for biasing said bail plate towards said platen, whereby said bail levers move in unison.

2. The paper bail of claim 1, wherein said bail levers are rotatably mounted on said printer and one side of said angle shaped section extends substantially transverse to a line connecting said bail plate with a rotational axis of said bail levers.

3. The paper bail of claim 2, wherein said bail plate includes stepped portions at said opposite ends, said stepped portions abutting against said bail levers.

4. The paper bail of claim 2, wherein said bail plate is L-shaped.

5. The paper bail of claim 2, wherein said one said of said angle shaped section extends from an other side of said angle shaped section directed toward said platen.

6. A paper bail in a printer having a platen, comprising:

an elongate bail plate having an axis;

at least one bail roller mounted on said bail plate; and means for mounting said bail plate relative to said platen such that said at least one bail roller is movable between a first position in contact with said platen and a second position out of contact with said platen, wherein said bail roller comprises:

(a) a cylindrical member engageable with said platen; and (b) elastic means for supporting said cylindrical member on said bail plate such that said cylindrical member can rotate about the axis of said bail plate but cannot move along said axis when said bail roller is in said first position, and such that said cylindrical member can move along said axis but cannot rotate about said axis when said bail roller is in said second position.

7. The paper bail of claim 6, wherein said bail plate is flat and bent along a line parallel to said axis.

8. The paper bail of claim 6, wherein said elastic means comprises an elastic member having an opening shaped to fit said bail plate, a substantially circular periphery in contact with said cylindrical member, and an elastic portion, wherein said elastic member frictionally holds said cylindrical member when said bail roller is in said second position and wherein elastic distortion of said elastic member causes frictional holding of said bail plate by said elastic member when said bail roller is in said first position.

* * * * *